United States Patent [19]

Winkler

[11] Patent Number: 4,662,634

[45] Date of Patent: May 5, 1987

[54] TENNIS RACKET WITH CONVEX THROAT

[75] Inventor: George C. Winkler, West Bend, Wis.

[73] Assignee: Chris Development Corporation, West Bend, Wis.

[21] Appl. No.: 616,436

[22] Filed: May 31, 1984

[51] Int. Cl.[4] ..... A63B 49/02

[52] U.S. Cl. ..... 273/73 G; 273/73 C

[58] Field of Search ..... 273/73 C, 73 B, 73 G, 273/73 J, 73 H, 73 R

[56] References Cited

U.S. PATENT DOCUMENTS

| | | | |
|---|---|---|---|
| 1,526,734 | 2/1925 | Andrews et al. | 273/73 C |
| 2,085,960 | 7/1937 | Donisthorpe . | |
| 4,042,238 | 1/1977 | Theriault | 273/73 C |

FOREIGN PATENT DOCUMENTS

| | | | |
|---|---|---|---|
| 2752624 | 5/1979 | Fed. Rep. of Germany . | |
| 827983 | 5/1938 | France | 273/73 J |
| 2450114 | 9/1980 | France . | |
| 2455906 | 12/1980 | France . | |
| 2464081 | 3/1981 | France . | |
| 431394 | 7/1935 | United Kingdom | 273/73 C |
| 446348 | 4/1936 | United Kingdom | 273/73 C |
| 2117253 | 10/1983 | United Kingdom | 273/73 D |

OTHER PUBLICATIONS

The Sporting Goods Dealer, "Squared Off Racket", May 1981.

World Tennis, "Racket Reviews", Dec. 1984, pp. 43–57.

"Three Products for Taming Tennis Elbow", Executive Fitness magazine, Sep. 1986, vol. 17, No. 17, p. 8.

News Article: "Chris Rackets Chosen for Eastern European Tour", West Bend News, Aug. 7, 1986, p. A-6.

"Tennis Rackets Enter the Space Age", High Technology magazine, Apr. 1986, pp. 54–55.

*Primary Examiner*—Richard C. Pinkham

*Assistant Examiner*—Matthew L. Schneider

*Attorney, Agent, or Firm*—Andrus, Sceales, Starke & Sawall

[57] ABSTRACT

A tennis racket (2) is disclosed having a throat (6) with a pair of outer convex curved sides (8, 10) bowed away from each other and extending between a handle (4) and a head (12). A widened and lengthened sweet spot area (34) is provided on the face (14) of the racket by the widened bridge (20) at the base of the head and a flat inner periphery surface (24) opposite thereto at the head tip (22) together with opposing inner flat surfaces (30, 32) along the sides (26, 28) of the head.

8 Claims, 1 Drawing Figure

TENNIS RACKET WITH CONVEX THROAT

BACKGROUND AND SUMMARY

The present invention relates to tennis and the like rackets.

Tennis rackets have a user-gripped handle from which extends a throat which in turn extends to a head having a face or hitting surface formed by a matrix of tensioned strings. The throat is typically formed by a single central longitudinal yoke and/or a bifurcated yoke having a pair of spaced sides extending between the handle and the head. In the latter type of racket, the throat sides are either straight or are concave and bow inwardly towards each other.

In the present invention, a throat is provided with a pair of outer convex curved sides bowed away from each other. This widens the bridge at the base of the head between the throat sides, to widen the sweet spot and power zone by bringing additional longitudinal main strings through the bridge and providing greater uniformity in the tensioning of such strings.

In combination with the wider bridge, straight flat sections are provided along the inner periphery of the tip of the head opposite the bridge and along the opposing facing sides of the head between the bridge and tip. The sweet spot is widened both longitudinally tip to base and laterally side to side, and the uniformity in tensioning of the longitudinal main strings is complemented by uniformity in tensioning of cross strings throughout the sweet spot area, resulting in a substantially larger sweet spot and power zone area than conventional tennis rackets.

The outer periphery of the convex throat side merges into the outer periphery of the head along a continuous unbroken curve of a positive radius of curvature without any transitions of negative radius of curvature. The continuous curvature of the head outer periphery in combination with the noted flat sections along the inner periphery of the head sides adds bulk, though not necessarily weight, to the head which in combination with the widened spacing of the convex throat sides at the head reduces torsional twisting torque moments on the user'hand due to off-center hits.

BRIEF DESCRIPTION OF THE DRAWING

The single drawing FIGURE is a top plan view of a tennis racket constructed in accordance with the invention.

DETAILED DESCRIPTION

Figure 1:
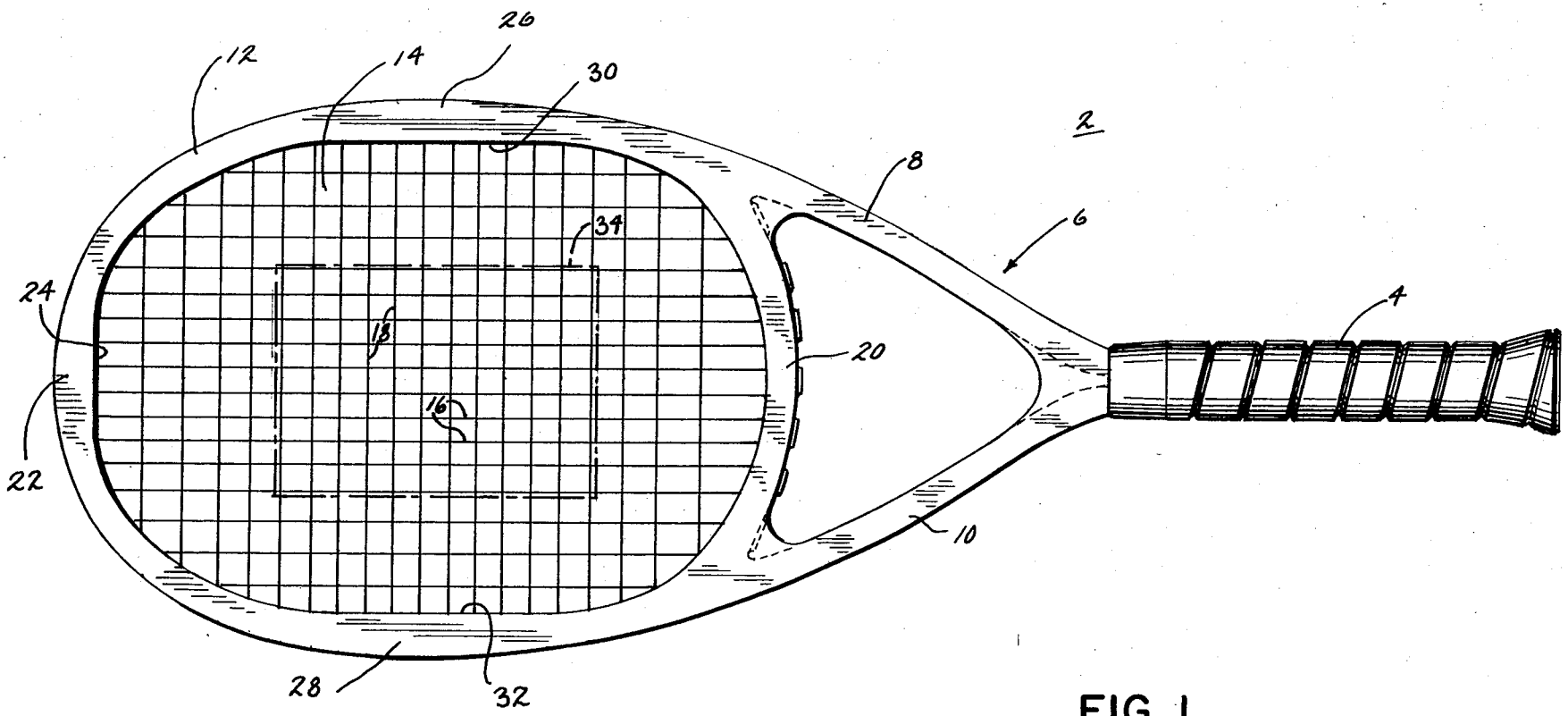

There is shown in the drawing a tennis racket 2 having a handle 4 grippable by the hand of a user, a throat 6 extending from the handle and comprising a pair of outer convex curved sides 8 and 10 bowed away from each other, and a strung head 12 extending from the throat. The head has a face or hitting surface 14 formed thereacross by a tensioned string matrix provided by a plurality of longitudinal main strings 16 and a plurality of lateral cross strings 18. The throat and head are preferably formed of a metal, such as graphite or aluminum, though other materials may of course be used. The strings may be of stretched gut, nylon, etc., and attached to the head in conventional manner, such as with grommets to protect the strings when passing through the sidewalls of the head.

The outer periphery of convex throat sides 8 and 10 merge into the outer periphery of head 12 along a continuous unbroken curve of a positive radius of curvature without any transitions of negative radius of curvature. Head 12 includes a bridge portion 20 at the base thereof extending between the convex throat sides along a 55° elipse. The head has a tip portion 22 extending along a 50° elipse. Bridge portion 20 has a radius of curvature greater than that of tip portion 22. Head tip portion 22 has a straight flat section 24 along the inner periphery thereof facing bridge portion 20. The head has a pair of opposite side portions 26 and 28 extending between the bridge and tip portions and having opposing facing straight flat sections 30 and 32 along the inner peripheries thereof.

The convex throat sides 8 and 10 provide a wider head bridge portion therebetween than straight or concave throat sides, to widen the sweet spot, and, in combination with flat sections 24, 30 and 32, widen the sweet spot both longitudinally tip to base and laterally side to side, and improve uniformity in string tension both tip to base and side to side. The continuous curvature of the head outer periphery in combination with flat sections 24, 30 and 32 adds bulk to the head which in combination with the widened spacing of the convex throat sides at the head reduces torsional twisting torque moments on the user's hand due to off-center hits.

In one particularly desirable implementation in a mid-size tennis racket, the invention enables at least ten longitudinal main strings of substantially the same length and tension to be brought through bridge 20, significantly widening the sweet spot and power zone. A mid-size racket typically has about seventeen longitudinal main strings and about twenty-two lateral cross strings, and has an overall width between the outer edges of the head of about ten inches, a head length of about thirteen inches, and an overall length from the base of the handle to the tip of the head of about twenty-seven inches.

The invention enables a substantially rectangular sweet spot area covering at least about 25–30 percent of the face 14 of the racket, which is a substantial increase over the sweet spot area of conventional rackets. This enlarged and rectangular sweet spot area is shown in dashed line at 34. At least about half of the longitudinal main strings extending tip to base of the head are of substantially the same length and tension, and at least about half of the lateral cross strings extending side to side of the head are of substantially the same length and tension. The intersection of these last mentioned longitudinal and lateral strings forms the noted 25–30 percent sweet spot area.

If the racket is constructed in accordance with the above noted mid-size example, the central ten of the longitudinal main strings are of substantially the same length and tension due to widened bridge 20 and opposing flat section 24, and define the width of rectangular sweet spot area 34. Flat section 24 has a length sufficient to substantially compensate the greater radius of curvature of bridge portion 20 and enable substantially uniform tensioning of central longitudinal main strings and to increase the number of such uniformly tensioned longitudinal main strings. The central twelve of the lateral cross strings are of substantially the same length and tension due to opposing facing flat sections 30 and 32 along head sides 26 and 28, and define the length of rectangular sweet spot area 34.

The increased width of the evenly tensioned longitudinal main strings, the uniformity of such width tip to base, and the evenly tensioned lateral cross strings, produce a larger power moment of inertia than a conventional racket of similar size. The center of percussion is moved upwardly toward the center of the head where it ideally should be. The wider bridge 20 provides greater elasticity for absorbing impact and increasing accuracy. This absorption in combination with the continuous outer periphery curvature of the throat and head and in combination with the widened and deepened sweet spot reduces vibration and shock to the wrist, arm and shoulder of the user. The above noted anti-twist feature further minimizes such shock and vibration by reducing torsional twisting torque moments on the user's hand.

The widened and outwardly swept throat sides provide a significantly different perspective to the user looking down the racket. This perspective promotes sweeping action through the ball, producing a solid, undisturbed follow-through. This perspective also gives the feeling and confidence of a much larger faced racket.

It is recognized that various alternatives are possible within the scope of the appended claims.

I claim:

1. A tennis or the like racket comprising:

a handle grippable by the hand of a user at one end;

a throat extending from the other end of said handle and comprising a pair of outer convex curved sides bowed away from each other; and a strung head extending from said throat and defining a flat hitting surface lying in a plane, said head having a bridge portion at the base thereof extending between said convex throat sides and having a tip portion distally opposite from said bridge portion and remote from said throat, said bridge portion having a greater radius of curvature than said tip portion;

wherein each of said throat sides is convexly curved in said plane of said head from a point immediately adjacent said handle and convexly curves all the way to said head without any straight sections therebetween and merges into said base of said head along a continuous unbroken curve of positive radius of curvature, including the section of said merger at said base of said head, without any transitions of negative radius of curvature.

2. The invention according to claim 1 wherein said tip portion of said head has a straight flat section along the inner periphery thereof facing said bridge portion, and wherein said head includes:

a pair of opposite side portions extending between said bridge and tip portions and having opposing facing straight flat sections along the inner peripheries thereof, said convex throat sides providing a wider said head bridge portion therebetween than straight or concave throat sides, to widen the sweet spot, and, in combination with said flat section at said head tip portion and said facing flat sections at said head side portions, widen the sweet spot both tip to base and side to side and provide uniformity in string tension across said sweet spot both tip to base and side to side.

3. A tennis or the like racket having a widened sweet spot, comprising:

a handle grippable by the hand of a user at one end;

a throat extending from the other end of said handle and comprising a pair of outer convex curved sides bowed away from each other;

a strung head extending from said throat and defining a flat hitting surface lying in a plane and having an outer periphery merging into the outer periphery of said convex throat sides, said head having a bridge portion at the base thereof extending between said convex throat sides, and a tip portion opposite said bridge portion; and means providing sufficient strength in said bridge portion and said throat sides to resist torsional flexure without a central brace or cross-piece in said throat, and with a completely open said throat, said last mentioned means comprising said bridge portion having a greater radius of curvature than said tip portion, said radius of curvature for said bridge portion being at least 10% greater than the radius of curvature for said tip portion and comprising said throat sides convexly curved in said plane of said head from a point immediately adjacent said handle and convexly curving all the way to said head without any straight sections therebetween and comprising said throat sides merging into said base of said head along a continuous unbroken curve of positive radius of curvature, including the section of merger with said base of said head, without any transitions of negative radius of curvature.

4. The invention according to claim 3 wherein said tip portion has a straight flat section along the inner periphery thereof facing said bridge portion, said flat section having a length sufficient to substantially compensate the greater radius of curvature of said bridge portion and enable substantially uniform tensioning of central longitudinal main strings between said base and tip portions and to increase the number of uniformly tensioned said central longitudinal main strings.

5. The invention according to claim 3 wherein said bridge portion extends along an approximately 55° elipse, and said tip portion extends along an approximately 50° elipse.

6. A tennis or the like racket comprising:

a handle grippable by the hand of a user at one end;

a throat extending from the other end of said handle and comprising a pair of outer convex curved sides bowed away from each other;

a strung head extending from said throat and defining a flat hitting surface lying in a plane, said head having a bridge portion at the base thereof extending between said convex throat sides and having a tip portion distally opposite said bridge portion and remote from said throat, said bridge portion having a greater radius of curvature than said tip portion; and means providing a wider said bridge portion between said convex throat sides than between concave throat sides, and a wider bridge portion than between straight throat sides, and a wider bridge portion than between convex throat sides having a transition of negative radius of curvature at merger with said head, said last mentioned means comprising each of said throat sides being convexly curved in said plane of said head from a point immediately adjacent said handle and convexly curving all the way to said head without any straight sections therebetween and merging into said base of said head along a continuous unbroken curve of positive radius of curvature, including the section of merger with said base of said head, without any transitions of negative radius of curvature.

7. The invention according to claim 6 wherein said wider bridge portion of said head also has an increased radius of curvature greater than or equal to about a 55° elipse.

8. The invention according to claim 6 wherein said throat is completely open without any central brace or crosspiece.

* * * * *